United States Patent [19]

Kinseley

[11] Patent Number: 4,863,131

[45] Date of Patent: Sep. 5, 1989

[54] PEGBOARD HOLDER DEVICE

[75] Inventor: Peter B. Kinseley, Weston, Conn.

[73] Assignee: Chesebrough-Pond

[21] Appl. No.: 820,358

[22] Filed: Jan. 21, 1986

[51] Int. Cl.[4] ..... A47B 96/06

[52] U.S. Cl. ..... 248/220.4; 211/59.2; 211/75; 248/312

[58] Field of Search ..... 248/220.4, 220.3, 312, 248/221.1, 221.2; 211/59.2, 74, 75, 66

[56] References Cited

U.S. PATENT DOCUMENTS

| | | | |
|---|---|---|---|
| 549,807 | 11/1895 | Mayer | 211/66 |
| 1,462,370 | 7/1923 | Lykins | 248/312 |
| 1,547,178 | 7/1925 | Long | 248/312 |
| 1,667,032 | 4/1928 | Franklin et al. | 248/312 |
| 2,057,946 | 10/1936 | Harris | 248/312 X |
| 2,772,787 | 12/1956 | Lee | 211/75 |
| 2,996,192 | 8/1961 | Dell et al. | 248/221.1 X |
| 3,250,303 | 5/1966 | Sollmann | 211/74 |
| 3,374,898 | 3/1968 | Karmin | 211/59 |
| 3,409,260 | 11/1968 | Bleed | 248/216 |
| 3,677,415 | 7/1972 | Radek | 211/59 |
| 3,850,396 | 11/1974 | Orlandi | 248/223 |
| 3,921,948 | 11/1975 | Long | 248/223 |
| 4,310,097 | 1/1982 | Merl | 211/59.2 |

FOREIGN PATENT DOCUMENTS 2928889 2/1981 Fed. Rep. of Germany ... 248/220.4

*Primary Examiner*—Ramon S. Britts
*Assistant Examiner*—David L. Talbott
*Attorney, Agent, or Firm*—Melvin H. Kurtz

[57] ABSTRACT

The present invention is a holder for detachably mounting an article on a vertical pegboard. It comprises prong and associated depending means which allow for mounting of the holder on a pegboard. Two generally equally spaced support rails extend outwardly from the pegboard when the article is mounted in the pegboard and are adapted to support the underside of an upper portion of the article to be held (e.g. a capped bottle). The holder terminates in a vertical end portion comprising two spaced apart rail members that are closer to one another at their lower portion adjacent the point of merger with the support rails but which have an upper portion of greater space therebetween. This design for the end portion of the article holder allows for outward movement of a portion of the article between the end rails only if the article is lifted from the support rails prior to being moved between the vertical end rails.

5 Claims, 1 Drawing Sheet

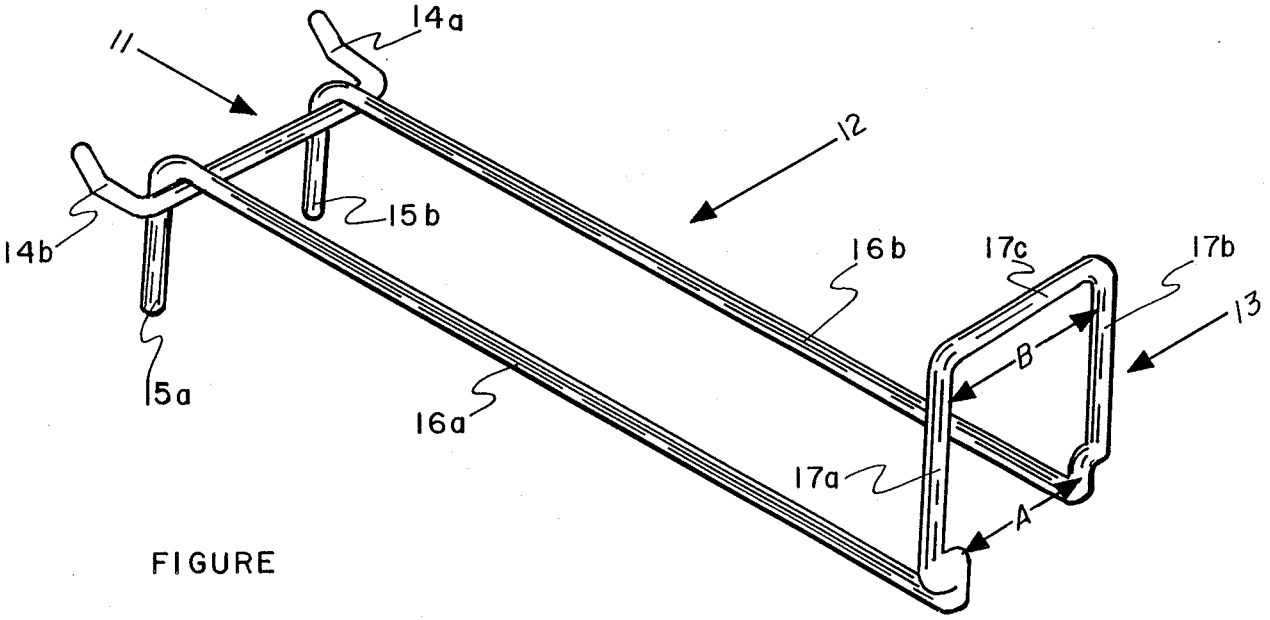
FIGURE

PEGBOARD HOLDER DEVICE

BACKGROUND OF THE INVENTION

1. Field of the Invention

The present invention relates to a holder for detachably mounting an article on a vertical pegboard. The holder of the present invention, in a preferred embodiment, is designed to hold capped containers (e.g., capped bottles) by supporting, for example, the underside of the cap.

2. Description of the Prior Art

Vertical pegboards containing a plurality of round apertures are known. Such a vertical mounting substrate has been conventionally used with suitable holders detachably mounted in the apertures to support a variety of articles. Examples of a variety of pegboard display hangers are given by U.S. Pat. Nos. 3,374,898; 3,409,260; 3,677,415; 3,850,396; and 3,921,948. The present invention relates to a novel design for such a article holder which can be used, for example, to support capped containers by the underside of either their cap or by a widened portion of the neck of the container.

SUMMARY OF THE PRESENT INVENTION

The holder of the present invention comprises generally horizontal prong means at one end which are adapted to be placed through the apertures in the pegboard to detachably hold the holder in a desired fixed position on the pegboard. Two generally equally spaced support rail members are joined to the prong means and are adapted to extend outwardly from the pegboard when the prong means are mounted in the apertures of the pegboard and held therein. The two spaced support rails are adapted to support the underside of the portion of the article to be held (e.g., the underside of the cap or underside of a thickened portion of the neck of the container). The holder of the present invention has a generally vertical end portion that is joined to the end of the support rails and that is remote from the prong end held by the pegboard. The end portion comprises two vertically oriented spaced apart rail members which are closer to one another at their lower portion adjacent their point of joinder to the support rail members. This closer distance acts to restrict the further outward movement of the supported article from the pegboard holder. The upper portion of the two spaced apart vertical end rail members has a greater space therebetween to allow for the outward movement therethrough of the portion of the article held upon the support rails when that article is to be removed from the holder.

DESCRIPTION OF THE FIGURE

The FIGURE which forms a portion of the present specification illustrates a perspective view of the holder of the present invention.

DETAILED DESCRIPTION OF THE PRESENT INVENTION

The FIGURE illustrates in perspective view the holder of the present invention which is adapted to be inserted at one end of a vertical pegboard to detachably but fixedly hold the holder in position on the board. The holder of the present invention comprises three main portions. The end 11 which is adapted to be mounted on the pegboard is indicated by reference numeral 11. The central portion which acts to support the desired article when stored on the holder is indicated by reference number 12. The end portion 13 of the holder article provides the means whereby the supported article is prevented from falling off its means of support and yet provision is made whereby the article can be easily removed from the support means if desired.

End 11 which is adapted to be held by the pegboard (not shown) comprises generally horizontal prong means **14*a* and 14*b* which are adapted to be placed through the apertures in the pegboard to detachably hold the holder in a desired fixed position on the pegboard. These prong means have a slightly bent end portion to allow for securement against the rear side of the pegboard in a known manner. In order to properly support the holder and prevent undesired rotation of outwardly protruding sections 12 and 13 downwardly, it is preferred to also have associated depending means 15*a* and 15*b* which are adapted to rest against the outer vertical surface of the pegboard thereby preventing downward rotation of support rail section 12 and vertical end portion 13**.

When end 11 has been fixedly mounted to the pegboard support section 12 extends outwardly, preferably at a very slight (about 5°–10°) downward slope, from the pegboard. The support section 12 is comprised of two generally equally spaced support rail members **16*a* and 16*b* which are suitably dimensioned to support a portion of the article to be held by the holder. In a preferred embodiment the space between support rails 16*a* and 16*b* is slightly less than the width of the upper portion of the article. For example, if the holder is adapted to support capped bottles, the space between rails 16*a* and 16*b* would be slightly less than the diameter of the cap so as to allow the cap to rest upon the upper surface of the rails. Alternatively, provision can be made in the upper portion of the container body of the capped container to allow for support by support rails 16*a* and 16*b*. If desired, support rails 16*a* and 16*b* can merge at their end adjacent end 11 with depending rails 15*a* and 15*b*** as shown in the FIGURE so that both sets of rails are integral with one another.

Generally vertical end portion 13 of the holder is joined to the end of the support rails **16*a* and 16*b* at the end lying remote from the pegboard mounting end 11. This vertical end portion 13 comprises two generally vertically oriented, spaced apart rail members 17*a* and 17*b* which are preferably joined together by top rail member 17*c*. The two spaced apart rail members 17*a* and 17*b* are closer to one another at their lowest portion adjacent the point of merger with support rail 16*a* and 16*b*. This is indicated in the FIGURE by letter A. The upper portions of rail 17*a* and 17*b*, however, are somewhat further apart from one another than their lower portions as illustrated by letter B in the FIGURE. This design for the generally vertical end portion 13 allows for removal of the articles from the support rails 16*a* and 16*b* only if the article is raised a sufficient distance to allow for movement of the uppermost portion of the article (e.g., the cap of a capped container) between vertical end rails 17*a* and 17*b* at position B. The lower distance between these two rails, which is signified by letter A in the FIGURE, is less than the diameter or transverse dimension of the article being supported on support rails 16*a* and 16*b*. This prevents the unintentional movement of the article past the vertical end portion 13** and insures the proper support of the article on the holder.

The foregoing illustrates certain preferred embodiments of the present invention and should not be construed in a limiting sense. The scope of protection that is desired is set forth in the claims which follow.

I claim:

1. A holder for detachably holding the supporting an article on a vertical pegboard which comprises:

(a) generally horizontal prong means at one end which are adapted to be placed through apertures in the pegboard to detachably hold the holder in a desired fixed position on the pegboard;

(b) two generally equally spaced support rail members joined to the prong means (a) and which are adapted to extend outwardly from the pegboard when (a) is releasably held by the pegboard, the rail members being adapted to support the underside of a portion of the article to be held; and (c) a generally vertical end portion joined to and at the end of the support rails (b) remote from the end (a) held by the pegboard, the end portion comprising two spaced apart rail members which are closer to one another at their lower portion adjacent the position of joinder with rail members (b) to restrict the further outward movement of the supported article from the pegboard but which have an upper portion of greater space between such rail members (c) to allow for outward movement therethrough of the portion of the article held upon support rails (b) when that article is to be removed from the holder.

2. A holder as claimed in claim 1 wherein (a) further comprises associated depending means which are adapted to rest against the surface of the pegboard.

3. A holder as claimed in claim 2 wherein the depending means comprises two spaced apart rail members.

4. A holder a claimed in claim 3 wherein the rail members (b) merge into the depending means and are integral therewith.

5. A holder as claimed in claim 3 wherein the rail members (b) merge into the depending means at one end and into the rail members forming end portion (c) at the other end so as to be integral therewith.

* * * * *